US008695849B2

(12) United States Patent
Butler

(10) Patent No.: US 8,695,849 B2
(45) Date of Patent: Apr. 15, 2014

(54) SPRAY DEVICE

(75) Inventor: Martin Butler, Hull (GB)

(73) Assignee: Reckitt Benckiser (UK) Limited, Slough, Berkshire (GB)

( * ) Notice: Subject to any disclaimer, the term of this patent is extended or adjusted under 35 U.S.C. 154(b) by 693 days.

(21) Appl. No.: 12/373,312

(22) PCT Filed: May 22, 2007

(86) PCT No.: PCT/GB2007/001907
§ 371 (c)(1),
(2), (4) Date: Jan. 12, 2009

(87) PCT Pub. No.: WO2008/009872
PCT Pub. Date: Jan. 24, 2008

(65) Prior Publication Data

US 2009/0302056 A1 Dec. 10, 2009

(30) Foreign Application Priority Data

Jul. 15, 2006 (GB) ..... 0614137.8

(51) Int. Cl.
*B67D 7/22* (2010.01)

(52) U.S. Cl.
USPC ..... 222/41; 222/48; 222/63; 222/333

(58) Field of Classification Search
USPC ..... 222/41, 63, 402.1, 504, 333, 402.13, 222/23, 47, 48, 49
See application file for complete search history.

(56) References Cited

U.S. PATENT DOCUMENTS

| | | | | |
|---|---|---|---|---|
| 2,991,912 | A | 7/1961 | Thomas et al. | |
| 3,185,350 | A * | 5/1965 | Abplanalp et al. | 222/402.11 |
| 3,368,717 | A | 2/1968 | Weber, III | |
| 4,252,455 | A * | 2/1981 | de la Pena | 401/190 |
| 4,838,456 | A * | 6/1989 | Hamlin | 222/1 |
| 5,318,208 | A | 6/1994 | Van Der Wal | |
| 5,702,036 | A * | 12/1997 | Ferrara, Jr. | 222/402.13 |
| 6,036,108 | A * | 3/2000 | Chen | 239/274 |
| 6,293,442 | B1 | 9/2001 | Mollayan | |

FOREIGN PATENT DOCUMENTS

| | | | |
|---|---|---|---|
| CH | 514362 | A | 10/1971 |
| DE | 1283065 | B | 2/1969 |
| FR | 2454810 | A | 11/1980 |
| GB | 1112649 | A | 5/1968 |
| GB | 1317294 | A | 5/1973 |
| GB | 1565010 | A | 4/1980 |
| GB | 1599153 | A | 9/1981 |
| GB | 2094407 | A | 9/1982 |
| JP | 09183470 | A | 7/1997 |
| WO | 0126448 | A1 | 4/2001 |

OTHER PUBLICATIONS

English Language Abstract for FR2454810 taken from Google Translate on Jan. 12, 2009.

(Continued)

*Primary Examiner* — Jason Boeckmann
(74) *Attorney, Agent, or Firm* — Norris McLaughlin & Marcus PA

(57) ABSTRACT

A spray device comprises spray container receiving means and spray container actuation means (102, 126), wherein the spray container actuation means are adapted to periodically cause ejection of spray material from a spray container (116) by means of an actuator arm (102), wherein the actuator arm (102) incorporates position indication means (144).

11 Claims, 4 Drawing Sheets

(56) References Cited

OTHER PUBLICATIONS

English Language Abstract for JP9183470 taken from esp@cenet.com.

English Language Abstract for CH514362 as translated on esp@cenet.com.

English Language Abstract for DE1283065 as translated on esp@cenet.com.

* cited by examiner

PRIOR ART

SPRAY DEVICE

This is an application filed under 35 USC 371 of PCT/GB2007/001907.

This invention relates to an apparatus for spraying a fragrance, a pest control material, a deodorising fluid, or similar, and to a container for use in a spraying apparatus and to a method of spraying.

Prior art devices for spraying fragrances, deodorising agents and sanitising fluids into a room consist of a mechanically actuated arm which is periodically activated to press down on a spray head secured to an aerosol canister containing the material to be sprayed.

The prior art devices are typically constructed as described below and as shown in FIGS. 1 and 2. An outer casing 12 has an opening 14 through which the spray is ejected. The casing 12 has a removable front section 12*a* which is removed to allow a refill canister 16 containing the spray material to be placed in the casing 12. A moulded spray head 22 is located over an outlet stem 20 of the aerosol spray canister 16. The spray head 22 has an inlet section 31 to be placed over the outlet stem 20 of the aerosol canister 16. Inner shoulders of the spray head 22 bear against the outlet stem 20 to cause material to be ejected from the canister 16 into the opening 30 and out of an outlet 22 of the spray head. A location block 23 allows location of the spray head 22 in the casing 12. An actuation arm 24 is located over the spray head 22 and is caused periodically to press against the spray head 22 to cause material from the aerosol canister 16 to be ejected through the spray head 22 out of the opening 14 in the casing and into the surroundings. The actuator arm 24 is either battery powered or mains powered and can be set to activate at various time intervals which, for example, may be to activate every seven minutes, every fifteen minutes or every thirty minutes, whichever is set by a user.

It has been found that disadvantages arise with these prior art spraying devices in that the direction of the spray is not well constrained and so the spraying of the material may occasionally miss the opening in the outer casing thereby wasting the spray material and not working efficiently. The spray head may twist sideways away from the outlet in the casing for example. Also, when replacing an empty canister 16, it is difficult for a user to see if the actuation arm is in a retracted position in which the canister 16 can be inserted or in an extended position in which the canister 16 may snag on the arm 24 and interfere with proper functioning of the device, or even permanently damage the canister 16.

It is an object of the present invention to address the above mentioned disadvantages.

According to an aspect of the present invention there is provided a spray device having spray container receiving means and spray container actuation means, wherein the spray container actuation means are adapted to periodically cause ejection of spray material from a spray container by means of an actuator arm, wherein the actuator arm incorporates position indication means.

The position indication means of the actuator arm may be a projection thereof, which projection preferably projects away from, preferably substantially perpendicularly away from, a front face of the actuator arm. The projection may project from a lower edge of actuator arm. The projection may project from a projecting land of the actuator arm, said land being forward of the front face of the actuator arm. The projection may taper towards an end thereof, and may have a flattened tip. The actuator arm is preferably operable to move between an activation position and a retracted position. When in the activation position the projection is generally parallel to, or more preferably coplanar with, an upper face of the spray container.

The spray container actuation means preferably has a cover portion, through which the position indication means preferably projects. The projection preferably projects approximately 2 mm to 4 mm from a front face of the cover portion.

The cover portion preferably incorporates a slot, through which the projection may project. The slot preferably comprises a spray container receiving section and a projection-travel section. Preferably, the two sections are at an angle to each other, preferably in the form of a dog-leg. The projection-travel section is preferably adapted to allow the projection to travel unhindered between the activation and retracted positions.

Preferably, the projection-travel section is adapted to allow greater visibility of the projection and/or the projecting land in the activation position compared to the retracted position.

The actuation means may include position adjustment means, adapted to allow a user to adjust the position of the actuator arm.

The position adjustment means may be the position indication means.

The spray device may include a spray container.

The invention extends to an actuator arm for a spray device, which actuator arm incorporates position indication means, and/or position adjustment means.

All of the features disclosed herein may be combined with any of the above aspects, in any combination.

For a better understanding of the invention, and to show how embodiments of the same may be carried into effect, reference will now be made, by way of example, to the accompanying diagrammatic drawings in which.

Figure 3A:
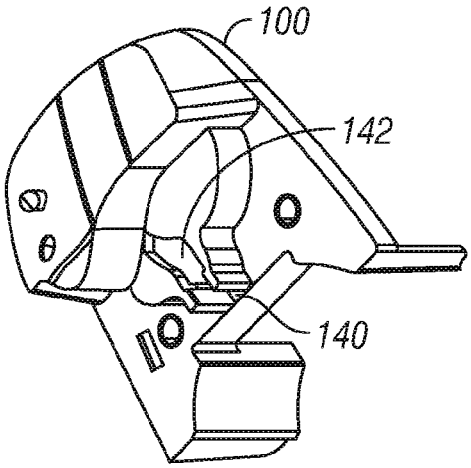
Figure 3B:
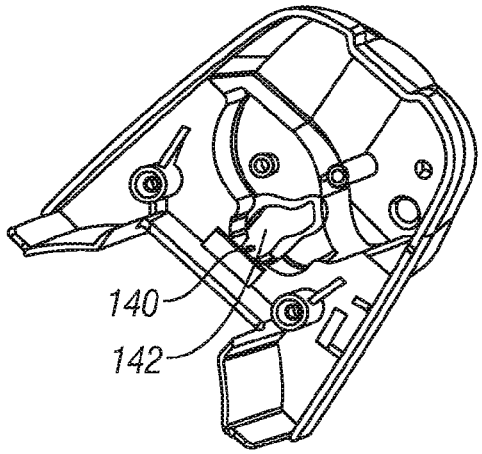
Figure 3C:
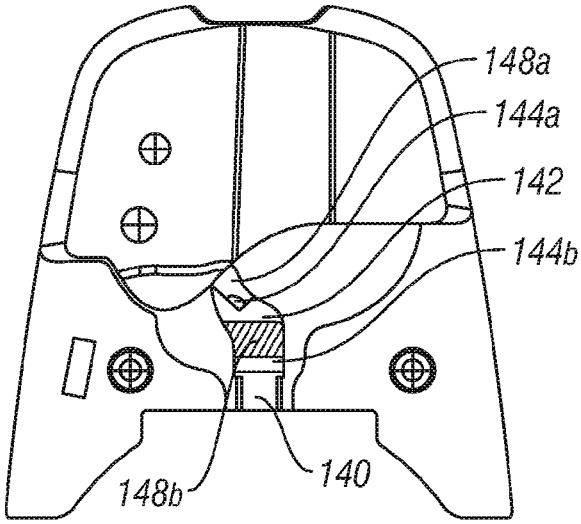
Figure 3D:
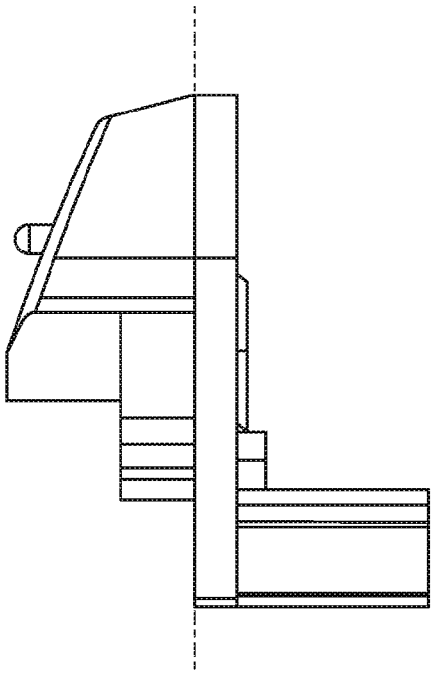
Figure 4A:
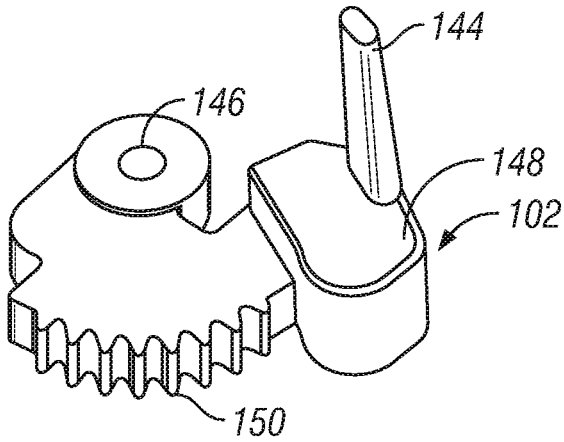
Figure 4B:
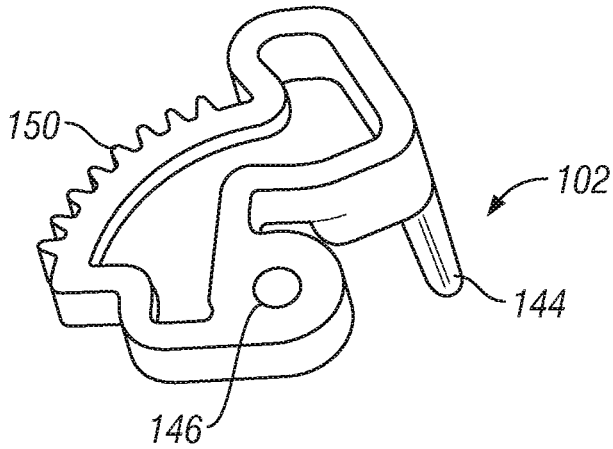
Figure 5:
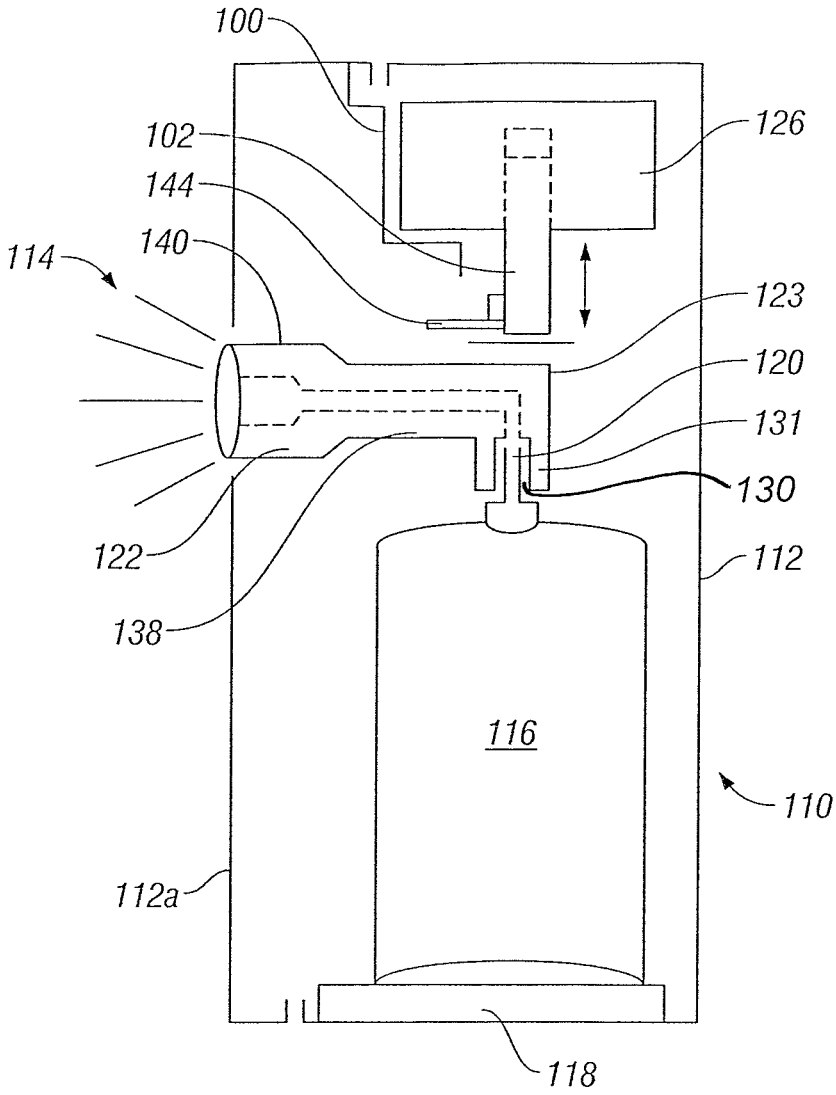

FIGS. 3*a* to 3*c* show schematic front perspective, rear perspective and front elevation views of a cover plate used in connection with a spraying device, and FIG. 3*d* shows a side view of the cover plate;

FIGS. 4*a* and 4*b* show schematic perspective front and rear views of lever arm for use with a spraying device having a cover plate as shown in FIGS. 3*a* to 3*c*; and FIG. 5 is a schematic perspective view of the spraying device parts of which are shown in FIGS. 3*a, b, c* and 4.

Figure 2:
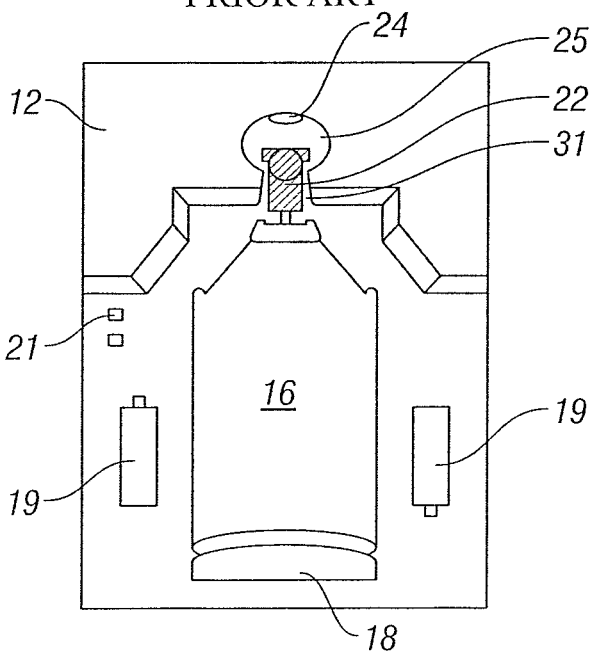
FIG. 2 is a schematic front view of the spraying device shown in FIG. 1.

The prior art spraying device shown in FIG. 2 incorporates an upper section with the reference numeral 12. With a view to addressing the disadvantages of the prior art devices discussed in the introduction, a cover plate 100 as shown in FIGS. 3*a* to 3*c* and a lever arm 102 shown in FIGS. 4*a* and 4*b* are to be used instead of the section 12 and arm 24 shown in FIG. 2. Otherwise, the general construction of the spraying device is much the same as shown in FIG. 2.

In use, a spraying device having the cover plate 100 and lever arm 102 is part of a device as shown in FIG. 5 which receives an aerosol spray canister 116 placed on a platform 118. An outlet stem 120 of the spray canister 116 is engaged in a lower opening 130 in a spray head 122. The aerosol spray canister 116 is a replaceable item, whilst the spray head 122 is typically supplied with the aerosol spray 116.

When the aerosol spray canister 116 is placed in position a fluid path for fragrance (or sterilising material or other material) for spraying is formed from the aerosol spray canister 116, through the spray head 122, to the opening 114 in a front section of an outer cover 112.

In order to cause spraying of the material within the aerosol spray canister 116, the lever arm 102 is caused to move down onto the spray head 122 by the actuator 126. The actuator 126 has numerous selectable settings which user may select with use of an adjustment control (not shown). The settings may be, for example, to cause the actuator arm 102 to move and cause spraying of the aerosol spray canister 116 every nine minutes, every eighteen minutes, every thirty-six minutes or any other of the large number of possible settings, as would be preferred by a user.

In order to locate the spray head 122 with respect to the cover plate 100, the spray head 122 has a location block 123 above a lower, inlet, section 131 of the spray head 122. The location block 123 is received in a location section 140 of the cover plate 100, shown in FIGS. 3*a* to 3*c*. The location section 140 receives the location block 123, the latter being wider than the inlet section 131. The location section 140 has a close fit with the inlet section 131. Space is allowed below the location block 125 to allow for vertical movement of the spray head 122 relative to the location section 140 when it is activated.

Reference is made in this description to the spraying device being a fragrance spraying device. The spraying device may also be used for spraying deodorising material sanitising materials or any other materials in the spray form. The apparatus described is typically for use in period spraying into a closed area such as a room. The apparatus is also described in relation to the use of an aerosol spray canister 116 for the material to be sprayed. However, different types of container other than aerosol container could be used.

In order to address the disadvantages discussed above, the lever arm 102 and the cover plate 100 have been developed.

The cover plate incorporates a curved opening 142 in which the lever arm 102 is located and along which opening 142 the lever arm 102 travels. In FIG. 3*c* a projection 144 of the lever arm is shown at a raised position (144*a*) and a lowered position (144*b*), to show the two extremes of motion of the lever arm 102 and the projection thereof 144 with respect to the curved opening 142.

The shape of the curved opening 142 has been chosen to allow an arc of motion for the projection 144 of the lever arm 102 as it moves upwards and downwards as it is activated by the actuator 126. The lever arm 102 moves in a pivoting motion about an opening 146 in which is received a fixing pin extending from the centre of one of a plurality of gear wheels that drive the lever arm 102, in the same manner known from the prior art.

The shape of the curved opening 142 as been chosen to more clearly demonstrate to a user that the projection 144 of the lever arm 102 moves between raised and lowered positions, which movement is not clear in the prior art devices. The presentation of the curved opening 142 in this manner allows a user to more easily discern whether the lever arm 102 is in a raised or lowered position, so that the user can more easily replace the spray canister 116 when it is spent.

The lever arm 102 differs from a prior art lever arm in that the projection 144 is present. The projection 144 projects through the curved opening 142 to clearly show to a user whether the lever arm 102 is in the raised or lowered position. As will be apparent from the description above, when the lever is in the raised position, as shown by the position 144*a* in FIG. 3*c*, it is possible for a user to insert a fresh canister 116, whereas when the lever arm 102 is lowered, as shown by the position of the projection 144*b* in FIG. 3*c*, it is more difficult for a user to insert a new canister 116, because the spray head 112 is more likely to foul on the lever arm 102 in the lowered position.

Thus, the projection 144, which extends out of the curved opening 142 provides a very clear visual indication to a user of the position of the lever arm 102. The projection 144 has a length of approximately 12 mm to allow it to project forward of a front face of the curved opening 142 by approximately 6 mm. Furthermore, a land 148 has been provided on the lever arm 102 to provide a further visual indication to a user of the position of the lever arm 102. In prior art actuator arms, the front face of the actuator arm was hollowed out and was more difficult to see. The land 148 extends approximately 3 mm forward of a front face of the lever arm. The land is visible at its lowered position at 148*b* in FIG. 3*c*. The land is visible in its raised position at 148*a* in that Figure. It is clearly much more visible when lowered.

Figure 1:
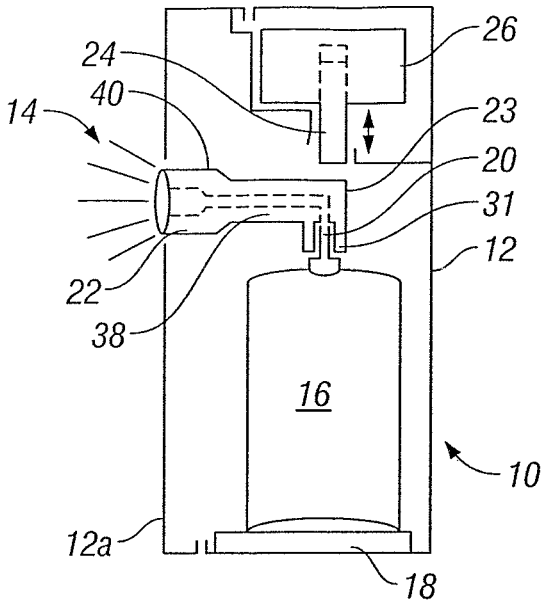
FIG. 1 PRIOR ART
FIG. 1 is a schematic view of a prior art spraying device.

Pivoting of the lever arm 102 is achieved by movement of a toothed wheel (not shown) with which a toothed section 150 of the lever arm 102 engages. Pivoting motion of the lever arm 102 is achieved about the opening 146, as mentioned above. The motion of the lever arm 102 is driven in the same way as the prior art discussed in relation to FIGS. 1 and 2.

The advantageous provision of the projection 144, the land 148 and the curved opening 142 provides the advantage of allowing a user to clearly see the position of the lever arm 102, which has not been possible with prior art devices.

Furthermore, the downward movement of the lever arm 102 is achieved by rotation of toothed wheels, as referred to above. Upward movement of the lever arm 102, as is the case with the prior art, is achieved by pressure from the aerosol canister 116 valve forcing the lever arm 102 back to the raised position. When the canister 116 is removed from the device, when it is spent, the canister cannot push the lever arm 102 back to the raised position. Consequently, it is typically the case that when a user removes the canister 116 the lever arm 102 is the lowered position. The prior art has required that the user uses a pin or pen, or other pointed object to raise an actuator arm to the raised position to allow insertion of a fresh canister. This is not required in the present case, because a user can easily push the projection 144 to cause the lever arm 102 to move to the raised position and allow easy insertion of the canister 116. This has significant advantages for ease of use by a user.

The projection 144 extends horizontally forwards from the base of the lever arm. This provides a greater surface area to the base of the lever arm 102. Consequently a greater surface area is provided with which the lever arm 102 contacts the spray head 122. Thus, the pressure of contact between the arm 102 and the spray head 122/canister 116 is reduced. This reduces the risk of failure of the stem 120 of the canister 116.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A spray device which comprises:

a spray container receiving means and a spray container actuation means, wherein the spray container actuation means includes a cover plate present within the interior of an outer cover of the spray device and inwardly of the outer cover, said cover plate comprising a location section adapted to receive a portion of a spray head of a spray container, which said spray container actuation means is adapted to periodically cause ejection of spray material from a spray container by means of a lever arm, wherein the lever arm incorporates a position indication means provided by a projection of said lever arm which projects perpendicularly away from a front face of said lever arm through a slot defining a curved opening in a front face of the cover plate but which projection does not extend outwardly from the outer cover, wherein the lever arm is operable to move between a lowered position and a raised position in the curved opening, and wherein the lever arm has a toothed section engaged with a toothed wheel of the spray container actuation means to move the lever arm in a pivoting motion between the lowered position and the raised position.

2. A spray device according to claim 1 in which the projection projects from a lower edge of the lever arm.

3. A spray device according to claim 1 in which the projection projects from a projecting land of the lever arm.

4. A spray device according claim 1 in which the projection tapers towards an end thereof.

5. A spray device according to claim 1, in which the projection is generally parallel to, or coplanar with, an upper face of the spray container when the projection is in the lowered position.

6. A spray device according to claim 1, in which the slot comprises a spray container receiving section and a projection-travel section.

7. A spray device according to claim 6, in which the two sections are at an angle to each other.

8. A spray device according to claim 6, in which the projection-travel section is adapted to allow the projection to travel unhindered between the lowered and raised positions.

9. A spray device according to claim 1, in which the actuation means includes position adjustment means adapted to allow a user to adjust the position of the actuator arm.

10. A spray device according to claim 9, in which the position adjustment means is the position indication means.

11. A spray device according to claim 1, which includes a spray container.

* * * * *